US005559089A

United States Patent [19]

Hartman et al.

[11] Patent Number: 5,559,089

[45] Date of Patent: Sep. 24, 1996

[54] LOW-DOSAGE AUTOMATIC DISHWASHING DETERGENT WITH MONOPERSULFATE AND ENZYMES

[75] Inventors: Frederick A. Hartman, Cincinnati; Ronald J. Rice, West Chester; James C. T. R. Burckett-St. Laurent, Cincinnati; Lucille F. Taylor, Middletown; Donna J. Haeggberg, Cincinnati, all of Ohio

[73] Assignee: The Procter & Gamble Company, Cincinnati, Ohio

[21] Appl. No.: 442,912

[22] Filed: May 17, 1995

Related U.S. Application Data

[63] Continuation-in-part of Ser. No. 108,783, Aug. 17, 1993, abandoned, which is a continuation of Ser. No. 849,907, Mar. 12, 1992, abandoned.

[51] Int. Cl.[6] ..... C11D 3/386; C11D 3/37; C11D 3/395

[52] U.S. Cl. ..... 510/224; 510/226; 510/227; 510/228; 510/233; 510/229; 510/230; 510/232; 510/363; 510/374; 510/530; 139/42

[58] Field of Search ..... 252/95, 174.12, 252/DIG. 12, 174.25, 174.25, 174.23, 174; 134/42

[56] References Cited

U.S. PATENT DOCUMENTS

| | | | |
|---|---|---|---|
| 3,049,495 | 8/1962 | Jenkins et al. | 252/102 |
| 3,353,902 | 11/1967 | Diamond et al. | 8/110 |
| 3,556,711 | 1/1971 | Stalter | 8/111 |
| 3,558,497 | 1/1971 | Lawes | 252/99 |
| 3,732,170 | 5/1973 | Demangeon | 252/95 |
| 3,805,809 | 4/1974 | Zeffren et al. | 132/7 |
| 3,819,828 | 6/1974 | McCoy | 424/71 |
| 3,933,672 | 1/1976 | Bartolotta et al. | 252/116 |
| 3,945,937 | 3/1976 | Villaumer | 252/102 |
| 4,127,496 | 11/1978 | Stokes | 252/102 |
| 4,427,417 | 1/1984 | Proasik | 23/313 R |
| 4,436,642 | 3/1984 | Scott | 252/92 |
| 4,485,028 | 11/1984 | King | 252/99 |
| 4,539,144 | 9/1985 | de Ridder et al. | 252/526 |
| 4,597,886 | 7/1986 | Goedhart et al. | 252/95 |
| 4,620,936 | 11/1986 | Kielman et al. | 252/99 |
| 4,652,392 | 3/1987 | Baginski et al. | 252/109 |
| 4,753,748 | 6/1988 | Laitem et al. | 252/99 |
| 4,810,413 | 7/1989 | Pancher et al. | 212/174.12 |
| 4,919,834 | 4/1990 | Chen et al. | 252/90 |
| 4,931,203 | 5/1990 | Ahmed et al. | 252/99 |
| 5,041,232 | 8/1991 | Batal et al. | 252/94 |
| 5,045,223 | 9/1991 | Batal et al. | 252/102 |
| 5,047,163 | 9/1991 | Batal et al. | 252/102 |
| 5,089,162 | 2/1992 | Rapisarda et al. | 252/102 |
| 5,152,910 | 10/1992 | Savio et al. | 252/95 |
| 5,173,207 | 12/1992 | Drapier et al. | 252/99 |
| 5,230,822 | 7/1993 | Kamel et al. | 252/174.13 |
| 5,240,633 | 8/1993 | Ahmed et al. | 252/99 |
| 5,374,369 | 12/1994 | Angevaare et al. | 252/102 |
| 5,384,062 | 1/1995 | Eoga et al. | 252/99 |
| 5,423,997 | 6/1995 | Ahmed et al. | 252/95 |
| 5,437,686 | 8/1995 | Heffner | 8/111 |

FOREIGN PATENT DOCUMENTS

| | | | |
|---|---|---|---|
| 82564 | 8/1982 | European Pat. Off. | C11D 3/37 |
| 135226 | 3/1985 | European Pat. Off. | C11D 3/39 |
| 239379 | 9/1987 | European Pat. Off. | C11D 3/386 |
| 0293055 | 11/1988 | European Pat. Off. | C11D 3/386 |
| 373613B1 | 6/1990 | European Pat. Off. | C07D 213/78 |
| 400858 | 12/1990 | European Pat. Off. | A61K 7/20 |
| 58-180420 | 10/1983 | Japan | A61K 7/30 |
| 1325645 | 8/1973 | United Kingdom | C11D 7/54 |
| 1381187 | 1/1975 | United Kingdom | C11D 3/60 |
| 1527706 | 10/1978 | United Kingdom | C11D 7/60 |

*Primary Examiner*—Paul Lieberman
*Assistant Examiner*—Kery A. Fries
*Attorney, Agent, or Firm*—Thomas G. Krivulka

[57] ABSTRACT

Automatic dishwashing detergents are provided in convenient, compact form without chlorine bleaches or phosphate builders. Thus, monopersulfate bleach such as $2KHSO_5.KHSO_4.K_2SO_4$ is used in combination with protease or amylase enzymes and acrylate organic dispersants to provide good cleaning of tableware. Weak builders such as citrate and pH-adjusting agents such as carbonate, bicarbonate and silicate can be present in the composition.

9 Claims, No Drawings

LOW-DOSAGE AUTOMATIC DISHWASHING DETERGENT WITH MONOPERSULFATE AND ENZYMES

CROSS-REFERENCE TO RELATED APPLICATION

This is a continuation-in-part of application U.S. Ser. No. 08/108,783, filed Aug. 17, 1993 now abandoned; which is a continuation of U.S. Ser. No. 07/849,907, filed Mar. 12, 1992, now abandoned.

TECHNICAL FIELD

The present invention is in the field of solid-form automatic dishwashing detergents. More specifically, the invention relates to nonphosphated (i.e., substantially free from inorganic phosphate builder salts) low-dosage forms of such compositions wherein there is present a beverage stain-removing amount of a monopersulfate salt. Granular and tabletted forms of the compositions are encompassed, as is a method of washing domestic tableware, such as dishes, glassware, cups and flatware, with the compositions here provided.

BACKGROUND OF THE INVENTION

Automatic dishwashing detergents (ADD's) used for washing tableware in the home or institutionally in machines especially designed for the purpose have long been known. The particular requirements of cleansing tableware and leaving it in a sanitary, essentially spotless, residue-free state has indeed resulted in so many particular ADD compositions that the body of art pertaining thereto is now recognized as quite distinct from other cleansing product arts. British Patents 1,325,645; 1,527,706; and 1,381,187; European Patent Application EP-A 82,564; and U.S. Pat. Nos. 4,427,417; 4,436,642; and 4,539,144 describe various aspects of ADD's, their components and their manufacture.

In recent times, there has been a renewed interest among consumers in effective, economical cleansing products, especially laundry detergents, using smaller amounts of chemicals and packaging for a diminished environmental impact. In light of legislation and current environmental trends, such products are desirably substantially free of inorganic phosphate builder salts. In addition, such compositions are desirably free of chlorine bleach and "inert" filler ingredients such as sodium sulfate.

Unfortunately, low-dosage nonphosphated ADD products may be made available to the consumer with a promise of effectiveness but in technical terms sacrificing efficacy, especially owing to the loss of phosphate and chlorine mainstay ingredients. Indeed, there does not currently appear to be a commercial low-dosage, nonphosphated ADD product which is economical and at the same time free from end-result shortcomings, such as relatively poor stain removal as compared with the same technology incorporated in regular-dosage nonphosphated formulas. Without being limited by theory, we believe stain removal shortcomings in particular are due to commercial perborate- and perborate-plus-activator ADD products relying quite heavily on a robust product matrix, which is lost in low-dosage product forms unless very expensive high levels of nonphosphorus builder are utilized.

In the course of exploratory studies to address this problem and secure improved low-dosage nonphosphated compositions which are both economical and effective, it has been discovered that perborate, perborate° with-activator (such as tetraacetylethylenediamine) and others among the conventional oxygen bleach technologies are relatively intolerant of significant reductions in levels of alkaline ingredients, builders and "inert" fillers (which actually function as electrolytes), all seemingly vital to successfully arriving at low-dosage forms of the ADD products. Moreover, these shortcomings are especially apparent when the compact-form ADD is used under "stressed" conditions, such as is frequently the case in high-hardness areas or among economy-minded consumers who use products sparingly.

One way round the problem would be to use chlorine bleaches, meaning chlorine-containing compounds which release hypochlorite when dissolved in water; but chlorine bleach limits the formulator since it is incompatible with many desirable components of nonphosphated ADD's, such as enzymes and many nonphosphorus builders and surfactants.

Accordingly, it is an object of the present invention to provide new and improved low-dosage ADD compositions. Such compositions are nonphosphated compositions, i.e., they are substantially free from, and unreliant on inorganic phosphate builders. The compositions herein are also free of chlorine bleach. More specifically, it is an object herein to provide low-dosage solid-form ADD's, especially granules, formulated with monopersulfate ("MPS") salts for highly effective removal of stains from tableware, especially beverage stains such as tea, tea with milk, or coffee, from cups and mugs. Dosages, that is to say usage levels of ADD in automatic dishwashing appliances, are generally from about 25%–70%, more typically from about 50%–60% of the dosage of a conventional phosphated, chlorine-bleach containing automatic dishwashing detergent. Another object herein is to provide a method for washing tableware in home or institutional automatic dishwashing appliances, especially in home appliances, using compositions provided herein at the specific dosage levels further detailed hereinafter.

The unique MPS-containing compositions herein provide numerous advantages in addition to compactness and stain-removal efficacy with economy. These include material protection via a reduced tendency to etch glass and tableware, excellent spotlessness and lack of filming, high water solubility and elimination of undissolved product residue, and the ability to remove proteinaceous food residues from articles such as pots and pans.

BACKGROUND ART

Monopersulfate salts, such as the potassium, sodium, and magnesium salts, as well as binary and ternary mixed salts of monopersulfate with alkali metal sulfates and/or bisulfates, are generally known from the literature. One such salt, sold as OXONE (registered trademark of DuPont), has been variously described in the literature as a mixture of potassium monopersulfate with potassium sulfate and potassium bisulfate, or as a "triple salt" having specific stoichiometry. The use of monopersulfate salts such as OXONE has previously been described. See: U.S. Pat. Nos. 3,049,495; 3,556,711; 3,558,497; 3,732,170; 3,805,809; 3,819,828; 3,945,937; 4,127,496; 5,041,232; 5,045,223; 5,047,163; European Patent Applications EP-A 135,226; EP-A 239,379; and EP-A 400,858; Japanese JP 58180420 A2; and South African ZA 8,301,869. Monopersulfate salts are chemically different from peroxydisulfate salts, such as potassium peroxydisulfate, $K_2S_2O_8$. Indeed, peroxydisulfate alone is not effective in the instant invention.

Unless otherwise noted, documents cited herein are incorporated by reference.

SUMMARY OF THE INVENTION

Compositions—The present invention encompasses low-dosage granular automatic dishwashing detergent compositions, in solid form, e.g., as granulates or tablets, which are substantially free of inorganic phosphate builders, substantially tree of chlorine bleach, and preferably substantially free of inert fillers such as sodium sulfate, comprising:

(a) monopersulfate salt in an amount sufficient to provide from about 0.18% to about 1.3% by weight, more preferably from about 0.36% to about 1.1%, most preferably from about 0.54% to about 0.9% by weight of the composition of Available Oxygen (this corresponds to the amount of monopersulfate salt required to establish a usage level of Available Oxygen of from about 5 ppm to about 35 ppm, more preferably from about 10 ppm to about 30 ppm, most preferably from about 15 ppm to about 25 ppm);

(b) detersive enzyme in an amount sufficient to provide from about 0.01% to about 0.5%, more preferably from about 0.02% to about 0.2% of the composition, of active enzyme (this corresponds to the amount of detersive enzyme required to establish a usage level of active enzyme of from about 0.5 ppm to about 5 ppm);

(c) from about 0.1% to about 10% by weight of the composition of an organic dispersant; (this ingredient is typically a water-soluble or water-dispersible polyelectrolyte capable of inhibiting the precipitation of water hardness salts; such dispersants include the sodium polyacrylates, mono- and dicarboxy starches and the like);

(d) pH adjusting agent in an amount sufficient to establish a usage pH in the range from about 8 to about 11, preferably from about 9.5 to about 10.5, at typical composition usage levels of from about 1500 ppm to about 4000 ppm, more preferably from about 2000 ppm to about 3000 ppm, in water; (pH adjusting agent will typically comprise (i) from 0% to about 30%, more preferably from about 5 % to about 25 %, most preferably from about 8% to about 20% of the composition of a carbonate ingredient and (ii) from 0% to about 35%, more preferably from about 4% to about 25%, most preferably from about 6% to about 15% of a water-soluble silicate ingredient; always subject to the provision that the sum of the levels of pH-adjusting agent components (i) and (ii) is greater than zero. The carbonate ingredient is typically selected from the group consisting of: sodium carbonate, sodium bicarbonate, sodium sesquicarbonate, potassium carbonate, potassium bicarbonate and potassium sesquicarbonate and mixtures thereof; more preferably this first component of the pH adjusting agent is selected from the group consisting of sodium carbonate, sodium bicarbonate, sodium sesquicarbonate and mixtures thereof. The water-soluble silicate ingredient is typically selected from the group consisting of hydrous sodium and potassium silicates having a $SiO_2$:$M_2O$ ratio in the range from about 1.6 to about 3, more preferably from about 2 to about 2.4 wherein M represents sodium or potassium).

Preferred embodiments of the invention comprise compositions having the above components (a) through (d) plus one or more of the following optional ingredients; in certain highly preferred embodiments of the invention, all of the optional ingredients are present at non-zero levels:

(e) from 0% to about 1.5%, more preferably from about 0.1% to about 0.5% by weight of the composition of a chlorine bleach scavenger; (when present, the chlorine bleach scavenger is typically sodium perborate, preferably in the monohydrate form): in other embodiments of the present invention, perborate or percarbonate, typically as sodium perborate monohydrate or as sodium percarbonate, can be used herein at levels of from 0% to 2% on an available oxygen basis, that is, from 0% to about 13.2% by weight, more preferably from about 1% to about 2% on an available oxygen basis, and may complement the stain removing action of the monopersulfate;

(f) from 0% to about 40%, more preferably from about 5% to about 30% by weight of the composition of a weak nonphosphorus builder; (when present, this builder is preferably selected from organic carboxylate builders having molecular weight of below about 600; more preferably the weak nonphosphorus builder is selected from the group consisting of an alkali metal salt of one or more of: citrate, tartrate succinates, glycerol succinates, carboxymethyloxysuccinate and glucoheptonate; most preferably this builder is sodium citrate in the trisodium, dihydrate form although citric acid may be equally useful in the lower-pH embodiments);

(g) from 0% to about 4% by weight of the composition, more preferably from about 0.1% to about 2%, most preferably from about 0.2% to about 0.7% by weight of the composition, of a bleach stabilizer; (when present, the bleach stabilizer is preferably selected from the group consisting of organic nitrogen-containing sequestrants and organic phosphorus-containing sequestrants, more preferably the bleach stabilizer is selected from the group consisting of organic nitrogen-containing sequestrants. Especially preferred nitrogen-containing sequestrants are ethylenediamine disuccinate, 1,2-oxoethanediyl-bis(aspartate) and diethylenetriaminepentacetate in acid or, more preferably, sodium-salt form); and (h) from about 0% to about 10% by weight, more preferably from about 1% to about 7 %, most preferably from about 2 % to about 5 % of the composition of a low-sudsing surfactant. (When present, the low-sudsing surfactant is typically one known for use in ADD's and is selected from low-sudsing nonionic surfactants, low-sudsing anionic surfactants and their mixtures; and mixtures of higher-sudsing surfactants with a conventional suds-suppressor such as a silicone/silica mixture).

In preferred embodiments, the invention is illustrated by a granular low-dosage automatic dishwashing detergent comprising:

potassium monopersulfate triple salt (OXONE) or tetraalkylammonium monopersulfate salt, typically tetrabutylammonium monopersulfate salt, in an amount sufficient to provide from about 0.10% to about 1.5% by weight of Available Oxygen, preferably from about 0.15% to about 0.5% of Available Oxygen, in the ADD composition;

from about 0.1% to about 2.5%, on an Available Oxygen basis in the ADD composition, preferably from about 0.7% to about 1.5% on an Available Oxygen basis, of sodium perborate, sodium percarbonate or mixtures thereof; and from about 0.1% to about 5%, preferably from about 0.5% to about 2%, on a weight basis in the ADD composition, of a low-sudsing surfactant, preferably a nonionic surfactant.

Such compositions can be further enhanced by the addition of limited amounts, e.g., from about 0.1% to about 3%, more preferably from about 0.5% to about 1.5%, on a weight basis, of a conventional bleach activator capable of forming a peracid which is different from peroxyacetic and peroxynonanioic acids: such a peracid is illustrated by peroxybenzoic acid. Such activators are illustrated by phenyl benzoate. Moreover, equivalent levels of peroxybenzoic acid or dibenzoyl peroxide may be added as a replacement for said activator component.

The overall cleaning performance of such compositions is desirably further enhanced by the addition of stability-enhanced amylases of specific types disclosed more fully hereinafter.

Method—The invention also encompasses a method for cleaning dishware, and the like, comprising in an automatic dishwashing appliance containing domestic tableware, such as flatware, cups and mugs, glassware, dinner plates and/or pots and pans, a step of washing said tableware by contact with an aqueous bath comprising from about 1500 ppm to about 4000 ppm, more preferably from about 2000 ppm to about 3000 ppm, of the instant composition. Preferably the appliance is a commercial domestic automatic dishwasher and there will be two such steps in sequence, with one or more rinse steps, in which no composition is dispensed, intervening between the said washing steps. Temperatures in the method can vary quite widely, but in accordance with normal practice, hot water preheated outside the appliance and having a temperature in the range from about 100° F. (37.8° C.) to about 150° F. (65.6° C.) may be used; alternatively, and depending on the power output of the heating coil which may be present in the appliance, cold water fill, such as at a temperature of from about 40° F. (4.4° C.) to about 80° F. (26.7° C.), can be used and the water is heated in the appliance to temperatures of about 150° F. (65.6° C.), or higher. In a preferred embodiment of the method, a washing step is followed by several rinse steps during which a conventional rinse agent may be dispensed to aid sheeting and drying action.

Units—All percentages, ratios and proportions herein are by weight, unless otherwise noted. When percentages are quoted without any particular indication as to whether the ADD compositions, their aqueous solutions at usage level, or percentages of components such as water in raw materials are intended, such percentages should be taken to refer to percentages by weight of the fully-formulated automatic dishwashing detergent. The abbreviation "ppm" refers to "parts by million". When "ppm" is used without indicating whether the ADD compositions or their aqueous solutions are intended, "ppm" should be taken to refer to usage-level parts by million of the indicated ingredient or composition in wash water.

DETAILED DESCRIPTION OF THE INVENTION

The present invention employs ingredients which are generally known in the art, but which are combined in a unique manner herein to provide important cleaning benefits in an automatic dishwashing detergent context. More specifically, the combination of the ingredients in the manner disclosed hereinafter allows the formulation of what might be referred to as "low dosage" or "compact" automatic dishwashing detergent compositions which are characterized by the fact that they contain lesser volumes of ingredients than conventional, granular dishwashing detergents now being sold, yet perform well under a wide variety of conditions. These lesser volumes are achieved without it being essential to resort to densification. "Densification" or "densified", as distinct from "compaction" or "compact" as used herein, refers to a process involving physically compressing the product by the application of pressure). Since excessive densification tends to adversely affect ADD solubility and since solubility of ADD's is prized by the consumer owing to the avoidance of undissolved detergent residues, the invention brings with it solubility advantages. Densities of typical compositions herein are in the range from about 0.7 g/cm3 to about 1.2 g/cm3, more preferably from about 0.8 g/cm3 to about 1.1 g/cm3. In light of the reduced volume and excellent solubility, the consumer is afforded more convenient compositions which, as used in properly functioning automatic dishwashing appliances, do not leave unsightly residues of undissolved detergent.

The compositions herein are formulated to be substantially free of inorganic phosphate salts (phosphate builders) and are substantially free of chlorine bleaches.

While it may be thought that the selection of non-chlorine bleaches for use in compositions of the present type is a routine affair, the selection of monopersulfate salts (sometimes known as monoperoxysulfate salts) from among the many known oxygen bleaches (e.g., perborate, percarbonate, peroxydisulfate, organic peracids, perborate-with-activator and the like) takes into consideration various factors designed to provide optimum cleaning performance in the present compositions. Without being bound by theory, optimum stain removal performance by low-dosage ADD's in the absence of conventional chlorine bleaches requires an oxygen bleaching species to be present throughout the washing operation. In a low-dosage ADD composition, this bleach at usage levels of only a few ppm to a few tens of ppm Available Oxygen in the wash water must operate at much lower electrolyte, hydroxide ion/pH adjusting agent and builder levels, as compared with the levels afforded by conventional dosage ADD's. It is now surprisingly revealed that of the known oxygen bleaches, monopersulfate salts do exceptionally well in this regard. Moreover high wash water temperatures or dispersed soils from the tableware can rapidly consume Available Oxygen, thereby preventing bleach from reaching and acting on the stained tableware. Again, it transpires thatmonopersulfate is effective for stain-removal in low-dosage ADD's while at the same time being relatively resistant to such causes of wastefull decomposition when formulated and used in accordance with the invention. In particular circumstances known as "stressed usage conditions", referring to high domestic water hardness, sparing use of ADD, excessively high or low wash temperatures and the like, monopersulfate salts as formulated herein are believed to provide superior stain removal results as compared with other conventional oxygen bleaches otherwise similarly formulated.

Monopersulfate Salts

Monopersulfate salts (MPS bleach) employed herein comprise compounds which dissociate in water to provide monopersulfate species such as $HSO_5^-$ or the corresponding dianion or radical anions. Such salts are illustrated by potassium monopersulfate, sodium monopersulfate, magnesium monopersulfate, and tetraalkylammonium monopersulfates such as tetrabutylammonium monopersulfate. A long-known and readily commercially available monopersulfate salt employed herein is a "triple salt". Commercial compositions comprising this salt are available under the tradename OXONE, from DuPont. OXONE has the Chemical Abstracts Registry Number 37222-66-5 and is in the form of a stable, free-flowing powder which comprises $2KHSO_5.K_2SO_4.KHSO_4$. Since this salt is the most readily available, it is used in many preferred embodiments of this invention. The lower molecular weight (and thus more mass-efficient) MPS salts are desirably used for low-dosage ADD compositions of the invention, but these salts are not commonly available in bulk, and must be made by conventional literature methods. Chemical practitioners will of course be aware that cations accompanying the monopersulfate can conveniently be exchanged by metathesis. Yet another approach is to ship bulk liquid stock of a solution of sodium or potassium monopersulfate, and, subject to the normal safety procedures for oxidants of this general type, dry or otherwise convert it adjacent the ADD manufacturing facility to whatsoever convenient solid form is desired.

In more detail, the present compositions include those comprising a persulfate salt selected from the group consisting of monopersulfates with any compatible cation. Compatible cations are typically (i) alkali metal cations, for example, sodium or potassium; (ii) alkaline earth cations, for example calcium or magnesium; (iii) quaternary ammonium cations, for example tetraalkylammonium; or (iv) cations which themselves contain a bleach-functional material, such as cations comprising a peroxycarboxylic acid, a ketone, or an acyl moiety.

Persulfates of the peroxydisulfate type are surprisingly ineffective herein. Without intending to be limited by theory, the problem with the peroxydisulfates is that, if used in the instant compositions, they are too slow-acting to be useful on the timescale of a wash in a typical automatic dishwashing appliance. Thus the present invention in no manner involves the mere recital of a catalog known persulfates, but rather, the careful selection of those useful for the instant purposes.

Preferred monopersulfates herein are selected from the group consisting of sodium monopersulfate, potassium monopersulfate, calcium monopersulfate, magnesium monopersulfate, tetralkylammonium monopersulfate, monopersulfate salts of cationic percarboxylic acids, complex monopersulfate salts such as OXONE, and mixtures thereof. More highly preferred by way of monopersulfate salt is a member selected from the group consisting of OXONE, tetraalkylammonium monopersulfate, monopersulfate salts of cationic percarboxylic acids, and alkaline earth monopersulfates.

Monopersulfate salts of cationic percarboxylic acids are further illustrated in EP 373613 B1 and U.S. Pat. No. 5,108,648 incorporated by reference, which describe pyridine-3-percarboxylic acid monopersulfate; and by the nitrogen-containing heterocyclic peroxycarboxylic acids of U.S. Pat. No. 5,268,472 and U.S. Pat. No. 5,117,049, both also incorporated by reference.

Tetralkylammonium monopersulfates are further illustrated by B. M. Trost and R. Braslau, J. Org. Chem. 1988, 53, 532–537, incorporated by reference, which discloses an impure form of tetrabutylammonium monopersulfate which is useful herein. Likewise useful are tetralkylammonium monopersulfates which have been purified, for example crude tetrabutylammonium monopersulfate or "tetrabutylammonium oxone" can be separated from potassium sulfate impurity by recrystallization from methylene chloride. Other tetraalkylammonium monopersulfates suitable herein are those having the formula $R^1R^2R^3R^4N{+}HSO_5^-$ wherein any of $R^1$–$R^4$ is a C1–C18 hydrocarbyl, preferably alkyl, benzyl or hydroxyalkyl. Preferred among said tetralkylammonium monopersulfates are the tetramethylammonium, tetraethylammonium, tetrapropylammonium, tetrabutylammonium, dimethyldibenzylammonium, textrahexylammonium, and dimethyldioctylammonium monopersulfates, though this illustration should not be considered as limiting. U.S. Pat. No. 3,353,902, incorporated by reference, further illustrates quaternary ammonium monopersulfates useful herein, as illustrated by dimethyl dihydrogenated tallow ammonium monoperoxysulfate (see Example 2 of U.S. Pat. No. '902). Surprisingly, none of the peroxydisulfate salts illustrated in the same patent is suitable for use herein.

Further, by way of the known versions and types of monopersulfate, the products of the methods of U.S. Pat. Nos. 3,041,139 and 3,927,189, incorporated by reference, are generally suitable for use herein, though the preferred monopersulfates are those which are relatively high in stability, more preferably still are also relatively low in hygroscopicity, as may be ascertained from the various storage stability tables in U.S. Pat. No. 3,041,139.

Available Oxygen (Monopersulfate)

"Available Oxygen" as defined herein when referring to monopersulfate salts refers to percentage by weight of titratable O (not $O_2$), inclusive only of titratable O from monopersulfate salts and specifically exclusive of titratable O from any active oxygen-containing chlorine bleach scavenger which may be used. Titration may be done using any convenient literature method for the determination of MPS bleaches, such as iodometric methods. See, for example, Skoog and West, Fundamentals of Analytical Chemistry, Holt, Rinehart, 1976, pages 362–369 and 748–751 [.] or supplier data sheets obtainable from the following monopersulfate suppliers: du Pont, Degussa, Solvay-Interox.

Conversion between Available Oxygen (AvO) and percentage of monopersulfate salt in any given composition is illustrated in the case of the pure monopersulfate triple salt $2KHSO_5.KHSO_4.K_2SO_4$ as follows:

triple salt molecular weight=614.74 g/mol;

mass fraction of Active Oxygen in pure triple salt=32/614.74; where 32 corresponds with two moles of Available O per mole of the triple salt in accordance with the presence of two moles of potassium monopersulfate in the triple salt formula;

Percentage of Available Oxygen in the pure triple salt=(32/614.74)*100=5.21% AvO.

Let us say, for example, that a given ADD composition in accordance with the invention containing only monopersulfate salts has a percentage of Available Oxygen of 0.78%

Then the percentage by weight of monopersulfate triple salt that it contains, assuming the salt is pure, is given by: 0.78/0.0521=14.97%

Similar conversions apply to any other composition in accordance with the invention, requiring only that the appropriate molecular weight of the monopersulfate salt be used. It will naturally be appreciated that commercial-grade monopersulfate salts can be used, such as OXONE triple salt formulated with commercial stabilizers and the like, in which case conversion from analyzed % AvO to percentage by weight of commercial-grade OXONE in the composition will include an assay factor. It has been found that commercial OXONE typically contains only about 88 percent by weight of the pure triple salt, accordingly a percentage by weight of the commercial sample will be increased by the assay factor: taking the above-given illustration, if the analyzed Available Oxygen in the composition was 0.78 %, the content of 88 % commercial OXONE would be:

(0.78/0.0521)*1/0.88=17.01% where 0.88 is the assay factor.

For simplicity, OXONE percentages other than in the detailed Examples are given on a pure basis herein, unless otherwise specifically indicated. Typically, the compositions herein will comprise from about 1% to about 9.5% by weight of MPS (as HSO%), which translates into about 3% to about 25% by weight OXONE, dry basis as the pure triple salt.

Available Oxygen—Perborate or Percarbonate

When the present compositions contain sodium perborate or sodium percarbonate, the content of these ingredients may be specified either on an available oxygen basis or on a percentage by weight basis. Using principles similar to those used above, it can readily be computed that sodium perborate monohydrate has a maximum available oxygen content of about 16%. In practice, commercial samples of sodium perborate and sodium percarbonate have typical Available oxygen contents in the range from about 13% to about 15.5%.

Detersive Enzyme—"Detersive enzyme", as used herein, means any enzyme having a cleaning, stain removing or otherwise beneficial effect in an ADD composition. The enzymes employed in the present compositions are of types well-known in the art. Such enzymes are commonly available in "prill" form. A prill is a fabricated particle containing varying proportions of active enzyme, inactive enzyme, and supporting materials which serve to stabilize the active enzyme during storage. For this reason, the levels of enzyme in the instant compositions are specified on the basis of active enzyme content. Assays may be carried out using any of the standard methods available from the enzyme suppliers. It is essentially immaterial to know the precise nature and level of the inactive components of the prill, except that it has been discovered that overly high levels of inactive enzyme and prill ingredients, e.g., above about 8% by weight of the fully-formulated ADD composition, actually tend to have adverse effects on the filming characteristics of the ADD; such levels should preferably be avoided.

Suitable enzymes herein comprise proteolytic enzymes well-known in the art. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred ADD compositions herein comprise one or more detersive enzymes. If only one enzyme is used, it is preferably an amyolytic enzyme when the composition is for automatic dishwashing use. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.0001% to about 10%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Proteolytic enzymes such as SAVINASE, ESPERASE and ALCALASE, sold by NOVO Industries, Copenhagen, Denmark, are particularly useful herein, since proteolytic enzymes serve to attack, degrade and remove various protein residues from the tableware being cleaned. Moreover, it has been discovered that in combination with oxygen bleach, such proteolytic enzymes, or their variants engineered for greater oxygen bleach stability, work exceptionally well for the removal of tea-with-milk stains from cups and mugs.

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of+99, +101, +103, +104, +107, +123, +27, +105, +109 , +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylase enzymes can also be used, either in combination with proteases in an optional, but preferred mode, or singly, in the compositions of the invention. Amylases suitable herein include, for example, α-amylases described in British Patent Specification No. 1,296,839 (Novo), RAPIDASE®, International Bio-Synthetics, Inc. and amylase sold by NOVO under the name TERMAMYL.

Engineering of enzymes (e.g., stability-enhanced amylase) for improved stability, e.g., oxidative stability is known. See, for example J. Biological Chem., Vol. 260, No. 11, June 1985, pp 6518–6521. "Reference amylase" refers to a conventional amylase inside the scope amylases useful in this invention. Further, stability-enhanced amylases, also useful herein, are typically superior to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention, as well as in inventive fabric laundering compositions herein. Even more preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the preferred embodiments of the invention can be obtained from Novo Nordisk A/S, or from Genencor International.

Preferred amylases herein have the commonality of being derived using site-directed mutagenesis from one or more of the Baccillus amylases, especially the Bacillus alphaamylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis,* or *B. stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. lichenformis* NCIB8061. Methionine (Met) was identified as the most likely residue to be modified. Met was substituted, one at a time, in positions 8,15, 197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832, CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. lipolyticum NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE® enzyme derived from *Humicola lanuginosa* and commercially available from Novo (see also EPO 341,947) is a preferred lipase for use herein. Another preferred lipase enzyme is the D96L variant of the native Humicola lanuginosa lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used herein. They are typically used in laundry products for "solution bleaching," i.e.

to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme activity and enzyme activity measurement are described in detail in the following publications, incorporated herein by reference: "Enzyme Nomenclature Recommendations (1972) of the International Union of Pure and Applied Chemistry and the International Union of Biochemistry", 2nd Reprint, 1975, ISBN 0-444-41139-9 and Publications B259c (Alcalase), B260c (Esperase) and B274c (Termamyl), all published March 1988 by Novo Industri A/S, Novo Alle', 2880 Bagsvaerd, Denmark.

Organic Dispersant

As noted hereinabove, the present compositions contain organic dispersant which overcomes the problem of unsightly films which form on china and especially on glassware due to calcium- or magnesium-hardness-induced precipitation of pH-adjusting agents, especially carbonates, used herein.

The organic dispersants herein are used at levels of at least about 0.1%, typically from about 1% to about 10%, most preferably from about 1% to about 7% of the automatic dishwashing composition. Such organic dispersants are preferably water-soluble sodium polycarboxylates. ("Polycarboxylate" dispersants herein generally contain truly polymeric numbers of carboxylate groups, e.g., 8 or more, as distinct from carboxylate builders, sometimes called "polycarboxylates" in the art when, in fact, they have relatively low numbers of carboxylate groups such as four per molecule.) The organic dispersants are known for their ability to disperse or suspend calcium and magnesium "hardness", e.g., carbonate salts. Crystal growth inhibition, e.g., of Ca/Mg carbonates, is another useful function of such materials. Preferably, such organic dispersants are polyacrylates or acrylate-containing copolymers. "Polymeric Dispersing Agents, SOKALAN", a printed publication of BASF Aktiengesellschaft, D-6700 Ludwigshaven, Germany, describes organic dispersants useful herein. Sodium polyacrylate having a nominal molecular weight of about 4500, obtainable from Rohm & Haas under the tradename as ACUSOL 445N, or acrylate/maleate copolymers such as are available under the tradename SOKALAN, from BASF Corp., are preferred dispersants herein. These polyanionic materials are, as noted, usually available as viscous aqueous solutions, often having dispersant concentrations of about 30–50%. The organic dispersant is most commonly fully neutralized; e.g., as the sodium salt form.

While the foregoing encompasses preferred organic dispersants for use herein, it will be appreciated that other oligomers and polymers of the general polycarboxylate type can be used, according to the desires of the formulator. Suitable polymers are generally at least partially neutralized in the form of their alkali metal, ammonium or other conventional cation salts. The alkali metal, especially sodium salts, are most preferred. While the molecular weight of such dispersants can vary over a wide range, it preferably is from about 1,000 to about 500,000, more preferably is from about 2,000 to about 250,000, and most preferably is from about 3,000 to about 100,000. Nonlimiting examples of such materials are as follows.

For example, other suitable organic dispersants include those disclosed in U.S. Pat. No. 3,308,067 issued Mar. 7, 1967, to Diehi, incorporated herein by reference. Unsaturated monomeric acids that can be polymerized to form suitable polymeric polycarboxylates include maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable, preferably when such segments do not constitute more than about 40% by weight of the polymer.

Other suitable organic dispersants for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 10,000 and an acrylamide content of from about 1% to about 15%, by weight of the polymer.

Still other useful organic dispersants include acrylate/maleate or acrylate/fumarate copolymers with an average molecular weight in acid form of from about 2,000 to about 0,000 and a ratio of acrylate to maleate or fumarate segments of from about 30:1 to about 2: 1. Other such suitable copolymers based on a mixture of unsaturated mono- and dicarboxylate monomers are disclosed in European Patent Application No. 66,915, published Dec. 15, 1982, incorporated herein by reference. Yet other organic dispersants are useful herein, as illustrated by water-soluble oxidized carbohydrates, e.g., oxidized starches prepared by art-disclosed methods. With regard to the formulations herein, it is preferred that the ratio of organic dispersant to Available Oxygen from monopersulfate salts is in the range from about 0.5:1 to about 8:1, preferably from about 0.5:1, to about 5:1, by weight.

pH-Adjusting Agent

The compositions herein also contain at least one source of alkalinity so as to achieve an in-use pH above 7. It will be appreciated by those familiar with compositions for use in the home that accidental ingestion of high alkalinity products can pose safety concerns. Moreover, such concerns would be increased in the case of highly alkaline, low-dosage compositions. While the invention is effective at a pH in the highly alkaline range, it is an advantage herein not to be limited to compositions with such alkalinity levels.

Wash pH's suitable for effective stain removal in the practice of this invention are generally in the range from about 8 to about 11, more preferably from about to about 9.5 to about 10.5 when water-soluble silicates are present though the invention encompasses other preferred embodiments in which the pH range is from about 8 to about 9.5, from which water-soluble silicates are absent and wherein the pH-adjusting function is performed only by the carbonate ingredient which can take the form of sodium bicarbonate or a sodium carbonate/bicarbonate mixture. To be noted, the perborate-type bleach systems are ineffective at the most desirable low end of these ranges, especially in the low-dosed product form provided herein. The water-soluble carbonate salts, especially sodium carbonate and bicarbonate, are useful alkalinity sources herein, and when present are typically used at levels from about 5% to about 25%, preferably from about 8% to about 20% by weight of the final granular product. It will be appreciated by those familiar with ADD compositions that excessive amounts of carbonate can result in undesirable filming on cleansed tableware. However, the tendency to filming is offset by use of organic dispersant materials disclosed hereinabove.

Importantly, material care benefits are best imparted to the instant compositions either when they are formulated at the moderate pH's (8–9.5) without soluble silicates (in which case sodium bicarbonate, sodium carbonate or a mixture of the two will be used for the pH-adjusting function), or when they are formulated at the somewhat higher (9.5–10.5) pH range when a mixture of water-soluble silicate and sodium carbonate is typically used as pH-adjusting agent.

When the compositions herein contain water-soluble silicate as a component of the pH-adjusting agent, these silicates not only provide alkalinity to the compositions, but also provide anti-corrosion benefits for aluminum utensils and appear to contribute to glaze protection on chinaware.

Since the compositions herein are formulated to contain limited amounts of free water for best storage stability, but since on the other hand complete dehydration of silicates tends to limit water-solubility of the compositions, it is important that the water-soluble silicates processed into the formulations ultimately have solid hydrous form. This can be achieved either by admixing into the composition preformed solid hydrous silicates as the water-soluble silicate component, or by relying on a more inexpensive liquid silicate stock, which is dehydrated to a limited extent during granule-making.

When water-soluble silicates are used in the practice of the invention, their level in the fully-formulated composition in preferred embodiments is in the range from about 4% to about 25%, more preferably from about 6% to about 15%, dry basis, based on the weight of the automatic dishwashing detergent composition. The mole ratio of $SiO_2$ to the alkali metal oxide ($M_2O$, where M is alkali metal) is typically from about 1 to about 3.2, preferably from about 1.6 to about 3, more preferably from about 2 to about 2.4. Preferable $H_2O$ levels in commercial raw material forms of the water-soluble silicate component itself are from about 15% to about 25%, more preferably, from about 17% to about 20% of the water-soluble silicate component.

The highly alkaline metasilicates can be employed, although the less alkaline hydrous alkali metal silicates having a $SiO_2$:$M_2O$ ratio of from about 2.0 to about 2.4 are preferred.

Sodium and potassium, and especially sodium silicates are preferred. Particularly preferred alkali metal silicates are granular hydrous sodium silicates having $SiO_2$:$Na_2O$ ratios of from 2.0 to 2.4 available from PQ Corporation, named BRITESIL H20 and BRITESIL H24. Most preferred is granular or powder-form hydrous sodium silicate having a $SiO_2$:$Na_2O$ ratio of about 2.0. Potassium analogs could be employed, but are generally more expensive.

While typical forms, i.e., powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Chlorine Bleach Scavenger

As noted hereinabove, the preferred compositions herein contain detersive enzymes. It has been determined that chlorine bleach species present in many water supplies can attack and inactivate such enzymes, especially under alkaline conditions. While chlorine levels in water may be small, typically in the range from about 0.5 ppm to about 1.75 ppm Available Chlorine, the total volume of water that comes in contact with the enzyme during dishwashing is usually large; accordingly, enzyme stability in-use can be problematic. Unlike the more conventional Oxygen bleach perborate, the monopersulfate bleach herein is not of its own accord a chlorine bleach scavenger. However, it has now been determined that scavenger materials such as sodium perborate can be used in the compositions as a chlorine scavenger. Accordingly, preferred compositions herein will contain up to about 1.5%, preferably from about 0.1% to about 0.5%, by weight of a chlorine bleach scavenger, such as a water-soluble perborate salt. Either sodium perborate tetrahydrate or sodium perborate monohydrate can be used for this chlorine scavenging purpose. Alternatively, boron-free scavengers may be used, in which case somewhat larger quantities may be useful. Preferred boron-free scavengers include percarbonate salts, malate salts, tartrate, ammonium sulfate and lower alkanolamines.

It may further be useful to have additional sodium perborate monohydrate or sodium percarbonate in the composition so as to further enhance tea stain removal. Thus, in general, levels of sodium perborate, sodium percarbonate or mixtures thereof herein may range from 0% to about 2% on an available oxygen basis, that is, from 0% to about 13.2% of the composition. In preferred embodiments, the content of sodium perborate monohydrate or sodium percarbonate is in the range from about 1% to about 2% on an available oxygen basis.

Weak Nonphosphorus Builder

The compositions herein may also contain a nonphosphorus detergency builder. It has been found that weak builders, especially organic carboxylate builders having a molecular weight below about 600, are especially useful to allow an effective composition which does not etch glass or chinaware. Normally, the formulators of detergent compositions attempt to employ high levels of the strongest possible builder in their formulations and indeed, when Oxygen bleaches such as perborate or perborate with activator are used, stronger builders are needed for the most satisfactory stain removal results. However, in conjunction with monopersulfate salts, the balance of the compositions herein provides adequate cleaning benefits even when zero to relatively low amounts of weak builders are used and this permits a substantial safety advantage with regard to the protection of the glaze on fine china and the strength and clarity of glassware. Citrate builders, particularly sodium citrate, are preferred for use herein. Glucoheptonate builders known in the art are likewise useful. Such builders, especially sodium citrate or citric acid, are preferably used at levels from about 2% to about 15% by weight, more preferably about 3 % to about 8% by weight of the present compositions.

Bleach Stabilizer

The compositions herein will preferably also contain a bleach stabilizer whose primary purpose is to sequester transition metal ions that can decompose monopersulfate bleach. Such bleach stabilizers generally are selected from organic nitrogen-containing sequestrants and organic phosphorus-containing sequestrants and are thus distinguished from the weak builders herein which do not contain nitrogen or phosphorus. Conveniently, bleach stabilizers can be blended with commercial monopersulfate in granular form, e.g., in OXONE granules. It may also be advantageous to have low levels of bleach stabilizer dispersed throughout the composition. In this mode, it is believed that the bleach stabilizer is principally active as a storage-stabilizer for the bleach. Otherwise, bleach stabilizers such as the common chelant diethylenetriaminepentaacetate can be added to the compositions to provide the desired stabilizing function.

In more detail, the bleach stabilizer in the fully-formulated granular automatic dishwashing detergent compositions herein can be used at levels ranging from the minimum amount required for bleach stabilizing purposes (e.g., as low as about 0.05% to 0.1%) to much higher levels (e.g., about 0.5% or higher) which are very useful levels not only for best achieving the instant process, but also for achieving enhanced functionality of the automatic dishwashing detergent (e.g., food/beverage stain removal from dishes, transition metal oxide film control or removal, and the like.) When bleach stabilizer is present, more typical levels are thus from about 0.05% to about 2% or higher, preferably from about 0.1% to about 0.7%, all percentages on a weight basis of the final automatic dishwashing composition.

Bleach stabilizers suitable for use herein of the organic nitrogen-containing type are further illustrated by the sodium and potassium salts of ethylenediaminetetraacetic acid (EDTA), diethylenetriamine pentaacetic acid (DTPA), hydroxyethylenediamine triacetic acid (HEDTA), triethylenetetramine hexaacetic acid (TTHA), nitrilotriacetic acid (NTA), N,N'-(1-oxo-1,2,-ethanediyl)-bis(aspartic acid) (OEDBA), and ethylenediamine disuccinic acid (EDDS); see U.S. Pat. No. 4,704,233.

Bleach stabilizers of the organic phosphorus containing type are further illustrated by ethylenediaminetetra-(methylenephosphonic acid), diethylenetriaminepenta(methylene phosphonic acid) and hydroxy-ethylidine-diphosphonic acid (EHDP). Certain of these materials have been found to behave somewhat unpredictably, it is believed due to variations in quality of raw material. Therefore, such organic phosphorus-containing sequestrants are not as highly preferred as the nitrogen types for use in the present invention.

Highly preferred bleach stabilizers are the nonphosphorus chelants, such as EDDS and OEDBA. These are believed to have attractive characteristics from the viewpoint of the environment; for example, EDDS has two chiral centers and not only synthetic or mixed isomers, but also the natural isomers such as the [S,S] isomer can be used compatibly with this invention.

Of the foregoing bleach stabilizers, all but OEDBA derivatives are well-known in the art. OEDBA is disclosed by Glogowski et al in U.S. Pat. No. 4,983,315, issued Jan. 8, 1991, incorporated herein by reference.

A document generally useful in the context of this invention for its disclosure of commercial chemicals, including but not limited to chelants, their trademark names and commercial sources of supply, is "Chem Cyclopedia 91, The Manual of Commercially Available Chemicals", a publication of the American Chemical Society, 1990, ISBN 08412-1877-3, incorporated herein by reference.

Although, the sodium and potassium, i.e., alkali metal salts of the bleach stabilizers are preferred, they can, in general, be in the acid form or can be partly or fully neutralized, e.g., as the sodium salt.

Low-Sudsing Surfactant

The compositions herein may contain from 0% to about 10%, preferably from about 1% to about 7% by weight of a surfactant, preferably a low sudsing surfactant of the type typically used in conventional ADD compositions known in commerce. Such surfactants not only provide some cleaning action in the compositions, but also provide a "sheeting" action which causes water to drain from china and glassware, thereby reducing the tendency to form unsightly spots during drying in the automatic dishwashing machine. Typically, such low sudsing surfactants fall within the class known as nonionics, especially the so-called "block" polyoxyethylene-polyoxypropylene nonionics, but various other low-sudsing surfactants such as the long-chain phosphates and phosphate esters can also be used. The following is intended to further assist the formulator in the selection of surfactants for use herein, but is not by way of limitation.

The surfactant can be, for example, an ethoxylated surfactant derived from the reaction of a monohydroxy alcohol or alkylphenol containing from about 8 to about 20 carbon atoms, excluding cyclic carbon atoms if such are present, with from about 4 to about 15 moles of ethylene oxide per mole of alcohol or alkyl phenol on an average basis. A particularly preferred ethoxylated nonionic surfactant is derived from a straight chain fatty alcohol containing from about 16 to about 20 carbon atoms ($C_6$–$C_{20}$) alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average. The ethoxylated nonionic surfactant can also optionally contain propylene oxide in an amount up to about 15% by weight of the surfactant.

Another type of nonionic surfactant contains the ethoxylated monohydroxyalcohol or alkyl phenol and additionally comprises a polyoxyethylene-polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds include those based on ethylene glycol, propylene glycol, glycerol, trimethylolpropane and ethylenediamine as an initiator reactive hydrogen compound. Polymeric compounds made from a sequential ethoxylation and propoxylation of initiator compounds with a single reactive hydrogen atom, such as $C_{12}$–$C_{28}$ aliphatic alcohols, do not usually provide satisfactory suds control. Certain of the block polymer surfactant compounds designated PLURONIC, PLURAFAC and TETRONIC by the BASF-Wyandotte Corp., Wyandotte, Mich. are suitable as the surfactant for use herein. A particularly preferred embodiment contains from about 40% to about 70% of a polyoxypropylene, polyoxyethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with trimethylol propane, containing 99 moles of propylene oxide and 24 moles of ethylene oxide per mole of trimethylol propane.

Additional surfactants useful herein include relatively low-molecular weight nonionic types having melting-points at or above ambient temperatures, such as octyldimethylamine N-oxide dihydrate, decyldimethylamine N-oxide dihydrate, C8–C12 N-methylglucamides and the like. Such surfactants may advantageously be blended in the instant compositions with short-chain anionic surfactants, such as sodium octyl sulfate and similar alkyl sulfates, though short-chain sulfonates such as sodium cumene sulfonate could also be used. Short-chain nonionic types which tend to be liquid or melt close to ambient temperatures may be incorporated into the instant compositions by wicking them into an inorganic support, such as preformed granule comprising porous carbonate particles. Thus nonionics derived from monohydric alkanols with ethylene oxide, such as C10E3 through C10ES, where "E" refers to ethylene oxide, may be used in the instant compositions.

Another suitable low foaming surfactant useful herein is SLF18® available from Olin Corp.

When sudsing tendencies of the compositions in-use are adversely affected by the use of surfactants with foaming tendencies, limited amounts of conventional suds suppressors such as silicone/silica mixtures, may be incorporated into the surfactant system of the instant compositions as taught in the literature.

Filler/Electrolyte

The MPS-containing compositions herein are formulated in "compact" form and are reliant on electrolyte level for stain removal to a lesser degree than otherwise similar compositions made using perborate or perborate/tetraacetylethylenediamine. Thus, the instant compositions can be made substantially free from, i.e., can be made with less than about 5%, and preferably contain 0%, of so-called "inert" ingredients such as sodium sulfate. Nonetheless, such filler ingredients may be used if desired provided that the detergent remains compact, within the spirit and scope of the invention.

Other Optional Adjuncts

Optional adjuncts useful in the practice of this invention include perfumes, borax and sodium or potassium borates, pH 7–9 organic buffers and any compounds in the published patent and journal literature known to accelerate or enhance the bleaching action of monopersulfate salts. A non-limiting example of such MPS-accelerator materials is the group consisting of keto-compounds, including sodium acetate and di-2-pyridyl ketone, the latter being more effective by virtue of the electronic effect of the substituents. Activation of monopersulfate is, of course, not limited to ketones in light of a variety of compounds having C=N and C=S bonds. To be noted, however, is that an advantage of the instant invention is its simplicity and lack of reliance on any such MPS-activating compound as an essential component. It has been found in the case of activated perborate-containing ADD 's that the activator, while helping bleaching and stain removal under the controlled conditions of technical test laboratories is capable of producing erratic performance in the home on account of segregation as well on account of the tendency of the highly reactive product of activation (peracetic acid) to decompose wastefully on heating or upon encountering dispersed food soils.

Other Preferred Embodiments

In other preferred embodiments, the invention encompasses a granular low-dosage automatic dishwashing detergent comprising:—a persulfate selected from the group consisting of OXONE monopersulfate triple salt and tetraalkylammonium monopersulfate;—a member selected from the group consisting of sodium perborate, sodium percarbonate and mixtures thereof; and—a member selected from the group consisting of low-sudsing nonionic surfactants. In one particularly preferred embodiment, said persulfate is a tetraalkylammonium monopersulfate. Such embodiments preferably include: from about 0.15% to about 0.5%, on an Available Oxygen basis, of said persulfate; from about 0.7% to about 1.5%, on an Available Oxygen basis, of said sodium perborate, sodium percarbonate or mixtures thereof; and from about 0.1% to about 5% of said low-sudsing nonionic surfactant.

Water Content

The water content of the compositions herein should be kept to a level below about 9% by weight of free moisture. This is due in part to the desirability of having free-flowing granules, and is particularly important when using OXONE as the monopersulfate salt. This monopersulfate salt is acidic and, in the presence of water, may react with carbonate or bicarbonate unless the limits on water content of the composition are respected or an expensive protective coating is applied. It is to be understood, however, that water can be used during the formation of the compositions herein. Thus, other than the monopersulfate, the balance of the compositions herein can be prepared as mixtures in an aqueous slurry and dried in standard fashion to provide substantially dry granules. Particles of dry monopersulfate can then be dry-blended with the aforesaid, dried balance of the composition.

The following examples illustrate compositions which come within the scope of this invention, but are not intended to be limiting thereof. In general, the compositions are prepared using the following general processing methodology.

Process

Although the art includes processes which rely on dry-mixing or spray-drying ingredients, such processes are not of the general kind of interest herein as they generally produce products with low density or high tendency to segregate in the package. Thus for the present purposes, conventional automatic dishwashing compositions can typically be made by a process comprising two essential stages: mixing/drying wet-and-dry ingredients, optionally including molten-form surfactants, to form particles having granulometry generally appropriate for the intended use; and mixing free-flowing, relatively dry components, of compatible granulometry, with the product of the first stage. The latter mixing stage is, of course, necessary since bleach-active salts such as monopersulfate and enzyme prills are not tolerant of the wet-stage processing.

As compared with the known processes for making granular automatic dishwashing detergents with oxygen bleach, preferred embodiments of this invention typically will comprise: (a) in the presence of water, forming a fluid premix consisting essentially of an organic dispersant and a bleach stabilizer; (b) one or more mixing/drying steps wherein the fluid premix is contacted with solid-form water-soluble nonphosphorus salts, very preferably, by means of conventional agglomeration and fluidized-bed drying equipment, sequentially; and (c) addition of bleach-active salts. Optionally, additional spray-ons or additions of other components such as perfumes, and the like, can be performed. Particularly desirable options which can be accommodated are illustrated by (i) inclusion of perfume in the step (a) premix; (ii) inclusion of fluid-form surfactant in step (b) and (iii) inclusion of hydrous silicates in step (c). Other optional adjuncts can also, in general, be added in steps (a), (b) or (c). Minors, e.g., perfume and colorants, typically comprise less than about 3 % of the finished formula.

The present composition is essentially free of inorganic phosphate builders, such as sodium tripolyphosphate. "Essentially free" is defined as less than about 1%, by weight of the composition, preferably less than about 0.5%, by weight of the composition.

The present composition is essentially free of chlorine bleach, such as sodium hypochlorite. "Essentially free" is defined as less than about 1%, preferably less than about 0.5%, by weight of the composition.

The present composition is essentially free of soluble chloride, such as sodium chloride. "Essentially free" is defined as less than about 1%, preferably less than about 0.5%, by weight of the composition.

The present composition is essentially free of soluble bromide, such as sodium bromide. "Essentially free" is defined as less than about 1%, preferably less than about 0.01%, by weight of the composition.

The present composition is essentially free of soap, such as C18 fatty acid or sodium salt thereof. "Essentially free" is defined as less than about 1%, preferably less than about 0.1%, by weight of the composition.

The following are nonlimiting examples:

EXAMPLE I

An ADD composition whose compactness is 60% that of conventional ADD compositions (i.e., 40% reduction in usage levels) is as follows. The composition is designed for use at about 23.4 g per wash cycle (3,600 ppm in wash water).

| Ingredient | % (wt.) |
|---|---|
| Trisodium citrate[1] | 13 |
| Sodium carbonate (anhydrous basis) | 17 |
| Silicate (2.0 ratio)[2] | 18 |
| Nonionic surfactant[3] | 4.3 |
| Sodium polyacrylate (m.w. 4,000)[4] | 5.0 |
| DTPA[5] | 0.83 |
| OXONE (% Av 0)[6] | 15 (0.69% AvO) |
| TERMAMYL 60 T prill[7] | 2.78 |
| SAVINASE 6.0 T prill[8] | 1.67 |
| $Na_2SO_4/H_2O$/minors[9] | Balance |

[1]Trisodium citrate dihydrate, expressed on anhydrous basis.
[2]BRITESIL $H_2O$, PQ Corp., expressed on anhydrous basis.
[3]$C_{18}E_{7.9}$ blend with reverse PO-20EO-PO block copolymer and monostearyl acid phosphate at a weight ratio of about 39:60:1.

-continued

| Ingredient | % (wt.) |
|---|---|

[4]ACCUSOL, Rohm & Haas.
[5]Diethylenetriamine pentaacetate, pentasodium salt, anhydrous basis.
[6]The first number quoted being percentage by weight of commercial-grade OXONE in the composition.
[7]Approximate prill content of active enzyme = 2.5%, dry basis.
[8]Approximate prill content of active enzyme = 1.5%, dry basis.
[9]Maximum 8% wt. $H_2O$ in composition.

EXAMPLE II

An ADD composition whose compactness is 50% that of conventional ADD compositions (i.e., 50% reduction in usage levels) is as follows. The composition is designed for use at about 19.5 g per wash cycle (3,000 ppm in wash water).

| Ingredient | % (wt.) |
|---|---|
| Trisodium citrate[1] | 15 |
| Sodium carbonate (anhydrous basis) | 20 |
| Silicate (2.0 ratio)[2] | 21.4 |
| Nonionic surfactant[3] | 3.5 |
| Sodium polyacrylate (m.w. 4,000)[4] | 5.3 |
| DTPA[5] | 2.44 |
| OXONE (% Av 0) | 20.7 (0.95% AvO) |
| TERMAMYL 60 T prill | 1.1 |
| SAVINASE 6.0 T prill | 3.0 |
| $H_2O$/minors[6] | Balance |

[1]Trisodium citrate dihydrate, expressed on anhydrous basis.
[2]BRITESIL $H_2O$, PQ Corp., expressed on anhydrous basis.
[3]$C_{18}E_{7.9}$ blend with block copolymer, as in Example I.
[4]ACCUSOL, Rohm & Haas.
[5]Diethylenetriamine pentaacetate, pentasodium salt, anhydrous basis.
[6]Maximum 8.5% wt. $H_2O$ in composition.

EXAMPLE III

An ADD composition whose compactness is 50% that of conventional ADD compositions (i.e., 50% reduction in usage levels) is as follows. The composition is designed for use at about 19.5 g per wash cycle (3,000 ppm in wash water).

| Ingredient | % (wt.) |
|---|---|
| Trisodium citrate[1] | 10 |
| Sodium carbonate | 20 |
| Silicate (2.0 ratio)[2] | 21 |
| Nonionic surfactant[3] | 3.5 |
| Sodium polyacrylate (m.w. 4,000)[4] | 5.3 |
| DTPA[5] | 2.44 |
| OXONE (% Av 0) | 15 (0.69% AvO) |
| SAVINASE 6.0 T prill | 1.6 |
| $Na_2SO_4/H_2O$/minors[6] | Balance |

[1]Trisodium citrate dihydrate, expressed on anhydrous basis.
[2]BRITESIL $H_2O$, PQ Corp., expressed on anhydrous basis.
[3]C18E7.9.
[4]ACCUSOL, Rohm & Haas.
[5]Diethylenetriamine pentaacetate, pentasodium salt.
[6]Maximum 7.5% wt. $H_2O$ in composition.

EXAMPLE IV

An ADD composition whose compactness is 50% that of conventional ADD compositions (i.e., 50% reduction in usage levels) is as follows. The composition is designed for use at about 19.5 g per wash cycle (3,000 ppm in wash water). This composition is less preferred owing to the relatively high level of expensive sodium citrate employed.)

| Ingredient | % (wt.) |
|---|---|
| Trisodium citrate[1] | 39 |
| Silicate (2.0 ratio $SiO_2$:$Na_2O$)[2] | 28.6 |
| Nonionic surfactant[3] | 1.4 |
| Organic dispersant[4] | 5.7 |
| OXONE (% Av 0) | 20.7 (0.95% AvO) |
| TERMAMYL 60 T prill | 2.4 |
| SAVINASE 6.0 T prill | 1.8 |
| $Na_2SO_4$/$H_2O$/minors[5] | Balance |

[1]Trisodium citrate dihydrate, expressed on anhydrous basis.
[2]BRITESIL $H_2O$, PQ Corp., expressed on anhydrous basis.
[3]$C_{18}E_{7.9}$.
[4]ACCUSOL, Rohm & Haas; sodium polyacrylate, m.w. 4,000.
[5]Maximum 6.5% wt. $H_2O$ in composition.

EXAMPLE V

An ADD composition whose compactness is 50% that of conventional ADD compositions (i.e., 50% reduction in usage levels) is as follows. The composition is designed for use at about 19.5 g per wash cycle (3,000 ppm in wash water).

| Ingredient | % (wt.) |
|---|---|
| Trisodium citrate[1] | 24.0 |
| Sodium carbonate | 12.5 |
| Silicate (2.0 ratio)[2] | 27.5 |
| Nonionic surfactant[3] | 1.5 |
| Organic dispersant[4] | 6.0 |
| OXONE (% Av 0) | 15.5 (0.7) |
| TERMAMYL 60 T prill | 0.8 |
| SAVINASE 6 T prill | 2.2 |
| $Na_2SO_4$ | 10.0 |
| $H_2O$/minors[5] | Balance |

[1]Trisodium citrate dihydrate, as supplied.
[2]BRITESIL $H_2O$, PQ Corp., as supplied.
[3]PLURAFAC LF 404, BASF Corp.
[4]Acrylate:maleate copolymer, sodium salt, m.w. 65,000, dry basis.
[5]Maximum 9% wt. $H_2O$ in composition.

(This composition, in use, typically delivers 0.29 ppm active enzyme TERMAMYL and 1.4 ppm active enzyme SAVINASE when 4,000 ppm product is dissolved in water.)

EXAMPLE VI

An ADD composition whose compactness is 60% that of conventional ADD compositions (i.e., 40% reduction in usage levels) is as follows. The composition is designed for use at about 23.4 g per wash cycle (3,600 ppm in wash water).

| Ingredient | % (wt.) |
|---|---|
| Trisodium citrate[1] | 20.0 |
| Sodium bicarbonate | 20.0 |
| Nonionic surfactant[2] | 5.0 |
| Organic dispersant[3] | 4.0 |
| DTPA[4] | 2.44 |
| OXONE (% Av 0) | 15.0 (0.69% AvO) |
| TERMAMYL 60 T prill | 1.1 |
| SAVINASE 6.0 T prill | 2.0 |
| $Na_2SO_4$/$H_2O$/minors[5] | Balance |

[1]Trisodium citrate dihydrate, expressed on anhydrous basis.
[2]PLURAFAC LF 404, BASF Corp.
[3]Acrylate:maleate copolymer, sodium salt, m.w. 65,000.
[4]Diethylenetriamine pentaacetate, pentasodium salt.
[5]Maximum 8% wt. $H_2O$ in composition.

EXAMPLE VII

The composition of Example VI is modified by removal of sufficient $Na_2SO_4$ to allow for the inclusion of 1% by weight of sodium perborate monohydrate. The resulting composition is useful in water containing chlorine bleaches.

EXAMPLE VIII

The composition of Example I is modified by the inclusion of 3% (wt.) octyl dimethylamine N-oxide dihydrate surfactant (see "High Active Alkyldimethylamine Oxides", K. R. Smith et al, J. Amer. Oil Chemists' Soc., 1991, Vol. 68, pp 619–622) to provide additional cleansing performance.

EXAMPLE IX

The following automatic dishwashing detergent compositions are prepared by mixing:

| INGREDIENTS | A wt % | B wt % | C wt % | D wt % |
|---|---|---|---|---|
| OXONE (R) (weight basis) | 4.9 | 4.9 | 0 | 0 |
| Tetrabutylammonium monopersulfate (weight basis) | 0 | 0 | 0.5 | 2 |
| Sodium Perborate Monohydrate (weight basis) | 13 | 0 | 7 | 10 |
| Sodium Percarbonate (weight basis) | 0 | 13 | 0 | 2 |
| Silicate: BRITESIL H2O ®, PQ Corp. (as $SiO_2$) | 9 | 7 | 8 | 9 |
| Low Foaming Nonionic Surfactant[10] | 3 | 1 | 1 | 2 |
| Polymeric Dispersant[11] | 7 | 8 | 3 | 5 |
| Chelant: Hydroxyethyldiphosphonate (HEDP), Sodium Salt | 0.5 | 0.1 | 0.5 | 0.5 |
| Chelant: Ethylenediamine Disuccinate, Trisodium Salt | 0 | 0.5 | 0.1 | 0 |
| Chelant: Diethylenetriamine-pentaacetic acid, Pentasodium | 0 | 0.3 | 0 | 0.1 |
| Builder: Trisodium Citrate Dihydrate (anhydrous basis) | 8 | 12 | 10 | 15 |
| Builder: Sodium Carbonate (anhydrous basis) | 20 | 20 | 10 | 15 |
| Detersive Enzyme: Savinase ® 6T (0.3 Au/g) | 3 | 2 | 3 | 1 |
| Detersive Enzyme: Termamyl ® 60T (600 AMU/g) | 1 | 1 | 0 | 1 |
| Sodium Sulfate, water, minors-Balance to: | 100 | 100 | 100 | 100 |

[10]SLF18 ®, Olin Corp. or LF404 ®, BASF.
[11] One or more of: Sokolan PA30 ®, BASF or Accusol 480N ®, Rohm & Haas.

The ADD compositions have compactness which is 50% that of conventional ADD compositions (i.e., 50% reduction in usage levels). The compositions are designed for use at about 19.5 g per wash cycle (3,000 ppm in wash water).

EXAMPLE X

Preparation of tetrabutylammonium monopersulfate, $Bu_4NHSO_5$, in accordance with literature procedure (after Trost et al, J. Org. Chem., Vol. 53, No.3, 1988, pages 532–537, incorporated herein by reference)

To a solution of OXONE® ($2KHSO_5.KHSO_4.K_2SO_4$, 10.86g, 18 mmol) in 45 ml water is added tetrabutylammonium bisulfate (30.0 g, 88 mmol) obtainable from Kodak Laboratory and Research Products. After being stirred at room temperature for 0.5 hour, the reaction mixture is extracted with dichloromethane (3×70 ml), the combined organic phase is dried over magnesium sulfate, and the solvent is evaporated in vacuo, yielding a white solid (25.64 g). The solid is titrated three times following this representative procedure: to a 0.1859 g sample is added 0.5 ml glacial acetic acid and 1 ml of 10% aqueous NaI. After dilution to 5 ml of THF, it is titrated with 3.30 ml of a 0.1012M solution of sodium sulfite to the yellow endpoint. The average of the three trials gives 37.5% by weight of active oxidizing agent, $Bu_4NHSO_5$.$^1$H NMR (200 MHz, $CDCl_3$): δ 3.2 (br t, 2H), 1.5 (br s, 2H), 1.3 (q, 2H), 0.85 (t, 3H). $^{13}$C NMR (15 MHz, $CDCl_3$): δ 57.7, 23.4, 29.2, 13.3. The sample is handled with care in accordance with the normal precautions required for a peroxide.

EXAMPLE XI

Tetrabutylammonium monopersulfate, in impure form as prepared in Example X, is multiply recrystallized from methylene chloride. Either the purified form (this Example) or impure form (Example X) can be used in the automatic dishwashing detergent compositions of the invention.

EXAMPLE XII

Tetrabutylammonium monopersulfate is prepared from tetrabutylammonium bisulfate and a 15% aqueous solution of Caro's acid, is extracted into methylene chloride, and is recrystallized therefrom.

EXAMPLE XIII

The following automatic dishwashing detergent compositions are prepared by mixing:

| INGREDIENTS | A wt % | B wt % | C wt % | D wt % |
|---|---|---|---|---|
| OXONE (R) (weight basis) | 4.9 | 4.9 | 0 | 0 |
| Tetrabutylammonium monopersulfate (weight basis) | 0 | 0 | 2 | 0 |
| Dioctyldimethlyammonium monopersulfate (weight basis) | 0 | 0 | 0 | 1 |
| Dimethyl dihydrogenated tallow ammonium monopersulfate | 0 | 0 | 0 | 0.5 |
| Sodium Perborate Monohydrate (weight basis) | 13 | 0 | 10 | 10 |
| Sodium Percarbonate (weight basis) | 0 | 13 | 0 | 2 |
| Dibenzoyl Peroxide | 0 | 0 | 1 | 0 |
| Phenyl Benzoate | 1 | 0 | 0 | 0 |
| Perbenzoic acid | 0 | 1 | 0 | 0 |
| Silicate: BRITESIL H2O ®, PQ Corp. (as $SiO_2$) | 9 | 7 | 8 | 9 |
| Low Foaming Nonionic Surfactant[10] | 3 | 1 | 1 | 2 |
| Polymeric Dispersant[11] | 7 | 8 | 3 | 5 |
| Chelant: Hydroxyethyldiphosphonate (HEDP), Sodium Salt | 0.5 | 0.1 | 0.5 | 0.5 |
| Chelant: Ethylenediamine Disuccinate, Trisodium Salt | 0 | 0.5 | 0.1 | 0 |
| Chelant: Diethylenetriaminepentaacetic acid, Pentasodium | 0 | 0.3 | 0 | 0.1 |
| Builder: Trisodium Citrate Dihydrate (anhydrous basis) | 8 | 12 | 10 | 15 |
| Builder: Sodium Carbonate (anhydrous basis) | 20 | 20 | 10 | 15 |
| Detersive Enzyme: Savinase ® 6T (0.3 Au/g) | 3 | 2 | 3 | 1 |
| Detersive Enzyme: Termamyl ® 60T (600 AMU/g) | 1 | 1 | 0 | 1 |
| Sodium Sulfate, water, minors-Balance to: | 100 | 100 | 100 | 100 |

-continued

| INGREDIENTS | A wt % | B wt % | C wt % | D wt % |
|---|---|---|---|---|

[10]defined above
[11]defined above

The ADD compositions have compactness which is 50% that of conventional ADD compositions (i.e., 50% reduction in usage levels). The compositions are designed for use at about 19.5 g per wash cycle (3,000 ppm in wash water).

The ADD's of the above dishwashing detergent composition examples are used to wash tea-stained cups, starch-soiled and spaghetti-soiled dishes, milk-soiled glasses, starch, cheese, egg or babyfood-soiled flatware, and tomato-stained plastic spatulas by loading the soiled dishes in a domestic automatic dishwashing appliance and washing using either cold fill, 60° C. peak, or uniformly 45°–50° C. wash cycles with a product concentration of the exemplary compositions of from about 1,000 to about 5,000 ppm, with excellent results.

The foregoing examples are illustrative and are not intended to be limiting of the invention. Thus, while granular compositions for domestic automatic dishwashing are the preferred form of composition, granular products for use in institutional dishwashing are equally encompassed.

What is claimed is:

1. A granular low-dosage automatic dishwashing detergent composition which is essentially free of inorganic phosphate builders and substantially free of chlorine bleach, comprising:

(a) from about 3.5% to about 25%, by weight, of monopersulfate salts selected from the group consisting of OXONE monopersulfate triple salt, $2KHSO_5.KHSO_4.K2SO_4$, tetraalkylammonium monopersulfate, and mixtures thereof;

(b) from about 0.01% to about 0.5% by weight of active detersive enzyme;

(c) from about 0.1% to about 10% by weight of an organic dispersant;

(d) from about 5% to about 25%, by weight, of a pH adjusting agent selected from the group consisting of carbonate, bicarbonate, and mixtures thereof;

(e) from about 4% to about 25%, by weight, of a water-soluble silicate;

(f) from about 0% to about 1.5% by weight of a chlorine scavenger;

(g) from about 0% to about 40% by weight; of a weak builder selected from the group consisting of water-soluble citrates, water-soluble glucoheptanates, and mixtures thereof;

(h) from about 0.1% to about 2% by weight of a bleach stabilizer; and (i) from about 0.1% to about 5% by weight of a low-sudsing surfactant; and wherein said composition has a density of from about 1.1g/cm3 to about 1.1 g/cm3.

2. A composition according to claim 1 wherein the weight ratio of organic dispersant to Available Oxygen from said monopersulfate salts is in the range from about 0.5:1 to about 5:1.

3. A composition according to claim 1 wherein the water soluble silicate is characterized by a mole ratio of $SiO_2$:$M_2O$ of from about 1.6 to about 3, wherein M is an alkali metal.

4. A composition according to claim 1 wherein the organic dispersant is selected from the group consisting of acrylate polymers and acrylate-maleate copolymers.

5. A composition according to claim 1 wherein the chlorine scavenger is a water-soluble perborate salt.

6. A composition according to claim 1, comprising:

(a) from about 3.5 % to about 25% by weight of a monopersulfate bleach of the formula $2KHSO_5.KHSO_4.K2SO_4$;

(b) from about 0.02% to about 0.2% by weight of a detersive protease or amylase enzyme, or mixtures thereof;

(c) from about 1% to about 7 % by weight of a low-sudsing nonionic surfactant;

(d) from about 5% to about 25% by weight of a water-soluble carbonate or bicarbonate ingredient, or mixtures thereof;

(e) from about 4% to about 25% by weight of a water-soluble silicate;

(f) from about 2% to about 15% by weight of a citrate builder;

(g) from about 0.1% to about 2% by weight of a bleach stabilizer;

(h) from about 1% to about 7% by weight of an organic dispersant; and (i) from 0% to about 1.5% by weight of a chlorine bleach scavenger; and wherein said composition has a density of from about 0.8 g/cm3 to about 1.1 g/cm3 and is in granular form.

7. The composition of claim 1 wherein said monopersulfate salt is a tetraalkylammonium monopersulfate.

8. A method for cleansing tableware in an automatic dishwashing machine, comprising: washing said tableware with an aqueous bath comprising from about 1,500 ppm to about 4,000 ppm of a composition according to claim 1.

9. A method according to claim 8 in which the tableware is contacted with an aqueous bath comprising from about 2,000 ppm to about 3,000 ppm of the composition of claim 7.

* * * * *